US005118550A

United States Patent [19]

Baravian et al.

[11] Patent Number: 5,118,550

[45] Date of Patent: Jun. 2, 1992

[54] SUBSTRATE BASED ON A NONWOVEN SHEET MADE OF CHEMICAL TEXTILE

[75] Inventors: Jean Baravian, Croissy/Seine; Jean-Jacques Beck; Jean-Claude Golly, both of Colmar, all of France

[73] Assignee: Rhone Poulenc Fibres, Lyons, France

[21] Appl. No.: 448,626

[22] Filed: Dec. 11, 1989

[30] Foreign Application Priority Data

Dec. 13, 1988 [FR] France ..... 88 16711

[51] Int. Cl.[5] ..... B05D 1/14

[52] U.S. Cl. ..... 428/90; 428/85; 428/95; 428/284; 428/285; 428/287; 428/293; 428/294; 428/296; 428/300; 428/489; 428/902

[58] Field of Search ..... 428/85, 90, 95, 293, 428/294, 296, 300, 489, 902, 287, 247, 285, 109, 90, 85, 95, 284, 296

[56] References Cited

U.S. PATENT DOCUMENTS

| | | | |
|---|---|---|---|
| 2,744,041 | 5/1956 | Balchen | 428/294 |
| 3,707,432 | 12/1972 | Corbin | 428/293 |
| 3,867,245 | 2/1975 | Herman | 428/294 |
| 4,173,670 | 11/1979 | VanAuken | 428/294 |
| 4,307,145 | 12/1981 | Goldman | 428/294 |
| 4,440,819 | 4/1984 | Rosser et al. | 428/109 |
| 4,464,429 | 8/1984 | Soret | 428/294 |
| 4,504,539 | 3/1985 | Patracek et al. | 428/294 |
| 4,532,169 | 7/1985 | Carley | 428/109 |
| 4,581,275 | 4/1986 | Endo et al. | 428/294 |
| 4,595,438 | 6/1986 | Kent et al. | 428/294 |
| 4,755,423 | 7/1988 | Greisner et al. | 428/489 |

*Primary Examiner*—James J. Bell

*Attorney, Agent, or Firm*—Sherman and Shalloway

[57] ABSTRACT

The present invention relates to a substrate based on nonwoven sheet for a flat article.

The substrate 11, with good dimensional stability in all the conditions of production, of subsequent treatments and of use, comprising at least one nonwoven sheet 8 based on chemical textile material in the form of continuous fibres or filaments is characterized in that the said sheet comprises high-modulus reinforcing threads 3 arranged parallel to each other in its lengthwise direction.

Glass threads are preferably employed as reinforcing threads. The reinforcing threads are combined with the nonwoven sheet by chemical bonding or heat-bonding and/or needling.

Use of the support as a sealing membrane reinforcement, primary or secondary substrate for tuft carpeting, reinforcement for floor covering tiling, substrate for laying, substrate for flock, and the like.

16 Claims, 6 Drawing Sheets

FIG. 1A
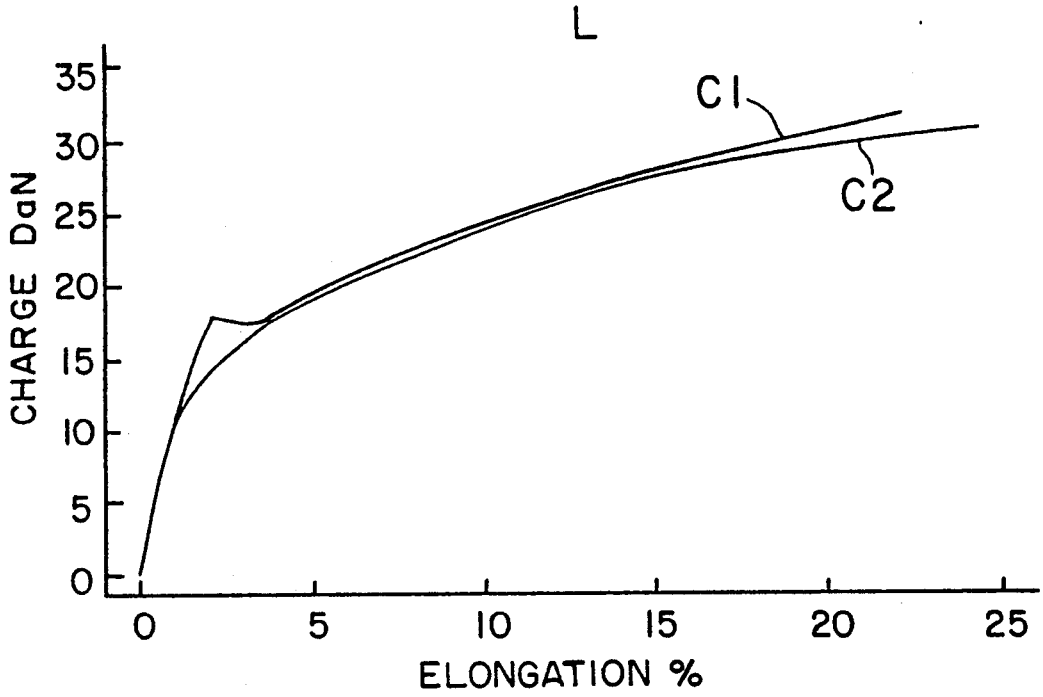
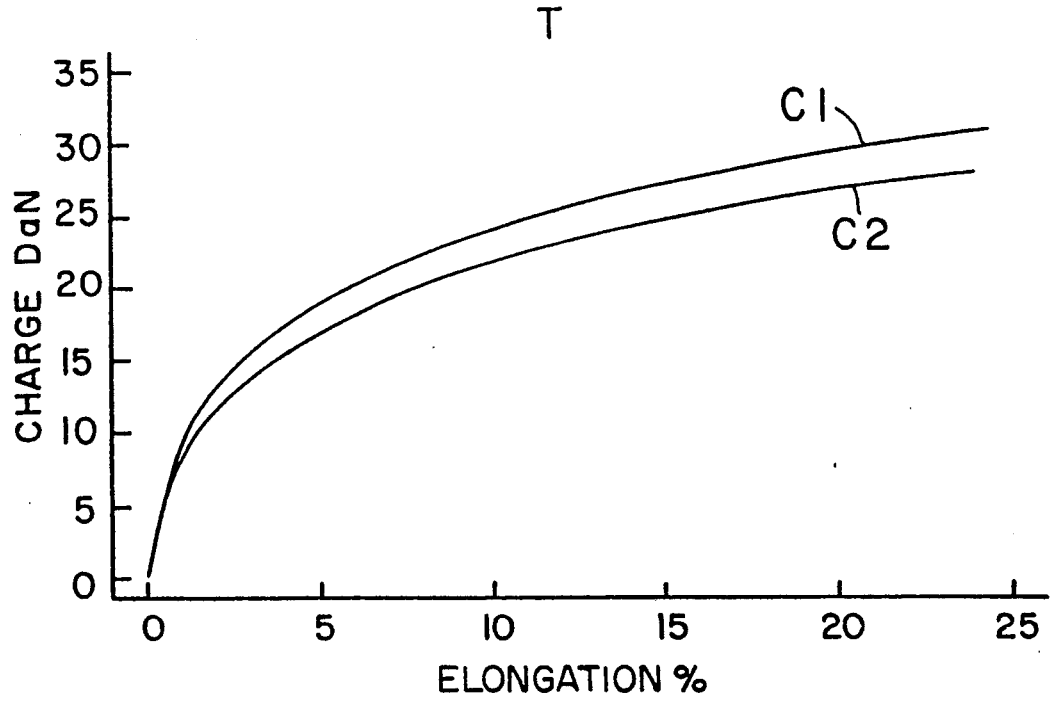
FIG. 1B

FIG.2A
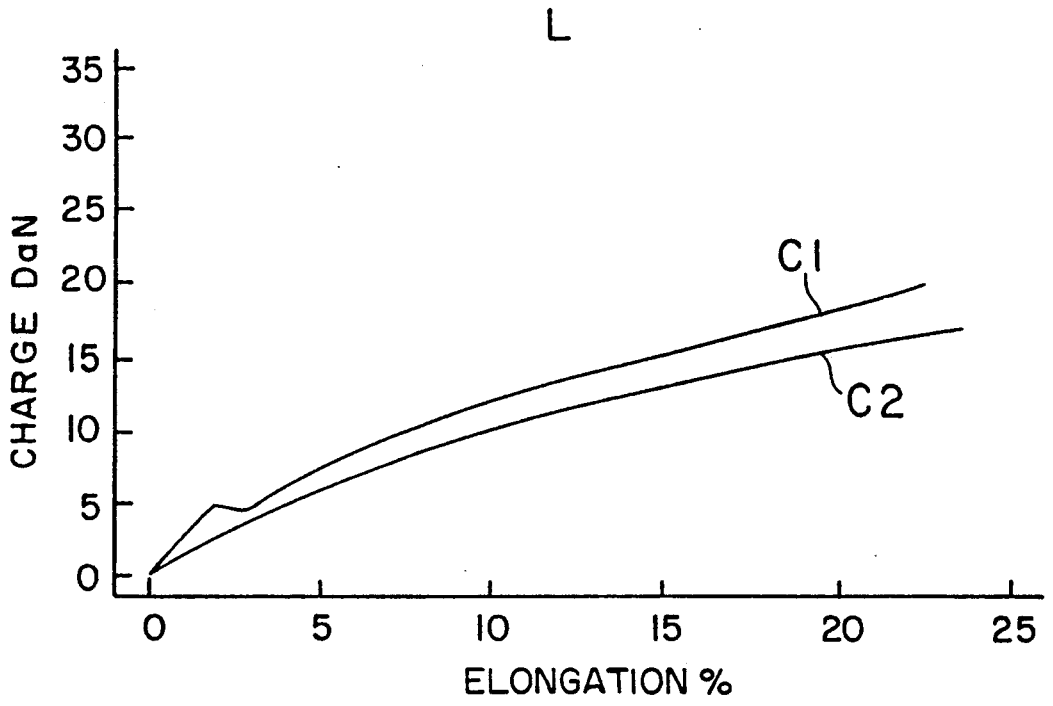
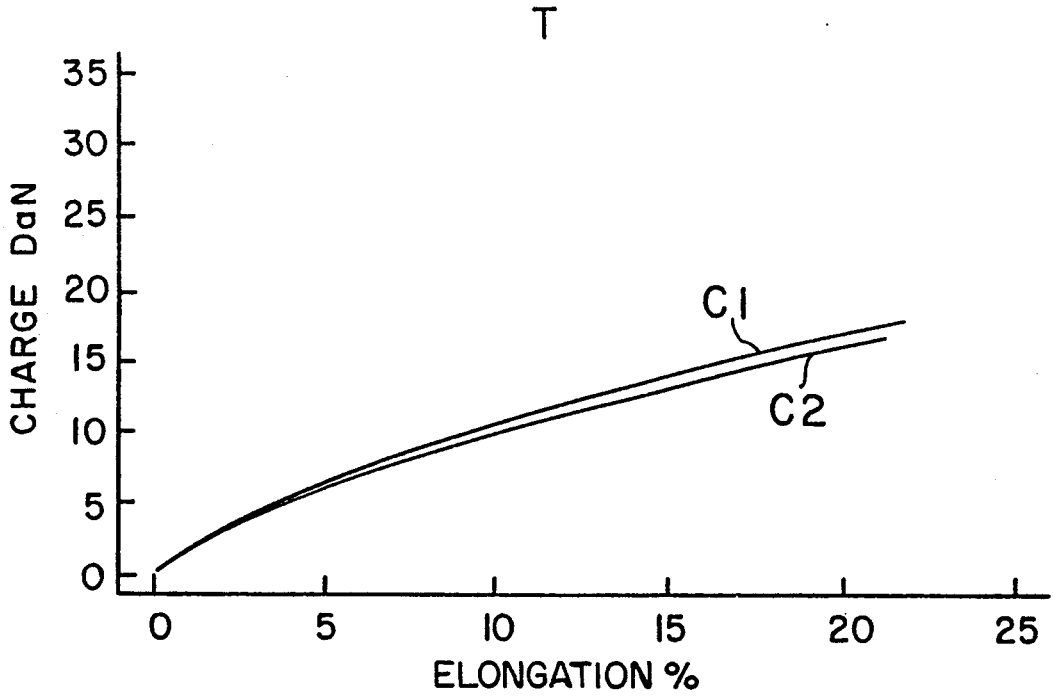
FIG.2B

SUBSTRATE BASED ON A NONWOVEN SHEET MADE OF CHEMICAL TEXTILE

The present invention relates to a substrate based on a nonwoven sheet made of chemical textile, dimensionally stable, and to a process for its manufacture.

It is known to employ nonwoven sheets made of chemical textile, in particular synthetic textile such as polyester, as a substrate in many applications: sealing membrane, floor coverings such as carpets (tuft, needleloom, etc.), tiles (plastic, textile), wall coverings, coating substrates, flock substrate, and the like.

As a general rule, the common feature of these articles is, on the one hand, the requirement of a high dimensional stability both when laid and on aging and, on the other hand, that of being subjected during manufacture simultaneously to high mechanical and thermal stresses which are generally higher than those undergone in the course of use; these stresses can result in risks of distortion: elongation in the lengthwise direction, shrinkage in the transverse direction and inverse distortions in the course of the aging of the laid article, because of the phenomenon of "elastic recovery", this more accurately in the case of light-weight substrates such as those of a weight equal to or lower than 150 g/m$^2$.

Thus, sealing membranes employed in the building industry frequently consist of a bituminous substrate or reinforcement. These substrates were originally jute and cellulose fibre fabrics, and then glass fibre voiles. A new generation of sealing products made its appearance a few years ago, contributing a marked step forward in this field, firstly by virtue of the spectacular improvement in the bitumens modified with elastomers and/or plastomers and, secondly, by virtue of the combined use of reinforcements based on nonwoven sheets made of polyester textile, chiefly polyethylene terephthalate, meeting the increased distortability requirements, enabling the dimensional changes of the substrates (roofs, terraces, thermal insulations) to be withstood better, and resulting in a very marked increase in the perforation resistance of the bitumen/reinforcement composites thus produced.

However, while, in most cases, the nonwovens (melt route, dry route, wet route) are mutually chemically bonded, which generally produces advantageous industrial results, this bonding operation makes use of special compositions of chemical products, is carried out with a repetition of processing and is finally found to be costly.

Furthermore, the results obtained are not perfectly satisfactory from the viewpoint of subsequent behaviour of the sheets, in particular in respect of dimensional stability, be it during the bitumen treatment or subsequently with regard to the coverings (membranes) produced and laid over roofing. As described above, it is found that this can give rise to distortions: shrinkage in the transverse direction and elongation in the lengthwise direction of the reinforcements during the bitumen treatment and after aging on roofing, inverse distortions and risks of corrugations, this more precisely in the case of the reinforcements with a weight of less than or equal to 150 g/m$^2$.

Now the present trend is to make the components of the bituminous covering lighter in weight, this being for economic and technical reasons: reduced costs and easier storage and handling. This is why, in the case of the lightest sealing membranes, many manufacturers employ a reinforcement consisting of a composite comprising at least one nonwoven sheet of polyester, in combination with a glass voile or a woven or adhesively bonded glass grid. The nonwoven and glass voile are generally combined during the operation of bitumen treatment by simultaneous impregnation of both reinforcements. It is also possible to combine the glass voile and the nonwoven polyester by needling or adhesive bonding.

Documents which describe such products are, for example, French Patent FR 2,562,471, in which a polyester nonwoven is combined with two outer layers based on glass fibre; U.S. Pat. No. 4,539,254, which describes a membrane comprising at least three layers bonded together, combining nonwoven(s), glass grid and polyester; and British Patent 1,517,595, in which a polyester nonwoven is combined with a lattice of glass threads (grid/crossed threads). In these embodiments, the quantity of glass, while limited so as not to increase the mass excessively, nevertheless remains relatively large, which entails a cost increase, when economics are considered.

Where technology is concerned, these various embodiments make it possible to improve the dimensional stability of the sealing membrane, once it has been laid. To a certain extent they also make it possible to reduce the distortions of the polyester sheet during the bitumen treatment, by limiting the elongation in the lengthwise direction when running through the machine and the shrinkage in width and the subsequent distortions linked with the tendency to elastic recovery of the coverings during the aging after laying over roofing.

However, these solutions are not entirely satisfactory, particularly in the case of two separate reinforcements. In fact, the bitumen impregnation is carried out by passing the sheet, or rather the nonwoven polyester + glass voile composite, through an impregnating trough. The quality of the impregnation depends on various factors, in particular the viscosity of the bitumen, defined as a function of the temperature and of the residence time, and on the mechanical diverting and draining systems in the baths. Since the temperature is limited because of the risks of polyester degradation, the residence time necessary must be sufficiently long for the impregnation to be complete, and this implies a run through the trough which is sufficiently long and hence running the composite over guides or bar feeders causing friction increasing the tensile stresses, which can go up to 80 daN/m of sheet width.

Now, under the combined effect of the temperature of the impregnation or surface treatment baths, frequently of the order of 160° to 200° C., and of the driving forces of the machine, the glass sheet and the polyester sheet may behave differently during the impregnation operation and during the relaxation of the covering, when laid, and this can produce surface nonuniformity phenomena: corrugations, cracks, and the like.

Furthermore, the mechanical behaviour of the doubly-reinforced covering is frequently very heterogeneous during the tensile phenomenon. In fact, because of its low elongation at break (less than 5%), the glass voile breaks firstly along preferential rupture lines. Where these rupture lines exist, the stresses on the polyester reinforcement, of higher elongation, are localized, but this localization entails a decrease in the overall load, elongation and fatigue strength characteristics. This can result in risks of fissuring on the covering.

Further progress was contributed by the Applicant Company in French Patent 2,546,537, which concerns a reinforcement for a sealing membrane and a membrane produced with this reinforcement, exhibiting good dimensional characteristics with time and, furthermore, produced in economically advantageous conditions. This sealing membrane is characterized in that its reinforcement is a nonwoven of heat-bonded continuous filaments, preferably needled, containing:

70 to 90% of polyethylene terephthalate, and
30 to 10% of polybutylene terephthalate.

The process of manufacture of this reinforcement is characterized in that a sheet of continuous filaments consisting of the two polymers is produced by extrusion, that the sheet obtained is optionally needled and that it is then continuously heat-bonded at a temperature of between 220° and 240° C. by causing the melting of the most fusible constituent.

To produce the sealing membrane, the reinforcement is treated with bitumen at a temperature below the temperature for heat-bonding the sheet filaments. After bitumen treatment, the whole is optionally subjected to the usual treatments such as sand or slate treatment. In this case, the use of a glass voile or grid together with the polyester nonwoven has been done away with, and this is technically and economically advantageous.

However, it has been found, in particular in the case of low weights per unit area of below or equal to 150 g/m$^2$, that some problems of dimensional stability still arise during the manufacture of the membrane from the sheet, more especially during the bitumen treatment, because of the high mechanical and thermal stresses, and in the conditions of use of the finished membrane on a terrace, where, owing to the elastic recovery phenomenon, distortions are produced with time, in a direction inverse to those arising during the manufacture.

It is also known to introduce lengthwise reinforcing threads of inorganic material into a glass voile, the said voile then being combined with a preconsolidated synthetic fibre sheet to obtain a sealing membrane substrate. A composite of this kind, the purpose of which is to offer firstly fireproof properties and secondly good dimensional stability, forms the subject of European Patent Application 0,242,524. However, while this application deals with the dimensional stability in the conditions of use (up to 80° C. and without stress), it says nothing about the stability of the product during the bitumen treatment, that is to say when subjected to high temperatures and stresses. Now, the behaviour during the bitumen treatment determines to a large extent the subsequent behaviour in the conditions of use and distortions during this treatment are also found to be subsequently detrimental.

Problems which are similar to those encountered in sealing arise also in the use as floor coverings.

In this application, for example, nonwoven sheets of synthetic textile are employed as a primary substrate (primary backing) and/or secondary substrate (secondary backing) for tuft carpeting. The manufacture of the carpeting comprises known operations such as: reverse coating, undercoat deposition, dyeing or printing, which subject the product simultaneously to high temperatures and to high stresses in the course of production. This can result in distortions: elongation in the lengthwise direction, shrinkage in the transverse direction of the primary and secondary backings and, as a result, a tendency to inverse distortions once the carpeting is laid, which is detrimental, in particular in the case of printing with patterns which can be joined up.

Similar risks of distortions during manufacture and of a tendency to inverse distortions on aging can also be encountered in the case of plastic or textile floor tiles reinforced with a nonwoven sheet, whereas these are articles which demand an excellent dimensional stability.

The objective of the present application is to solve the above problems. Its subject is a substrate based on a nonwoven sheet for a flat article, with good dimensional stability in all the conditions of production, of subsequent treatments and of use, comprising at least one nonwoven sheet based on chemical textile material in the form of fibres or of continuous filaments, characterized in that the said sheet comprises high-modulus reinforcement threads arranged parallel to each other in the lengthwise direction.

The nonwoven sheet may be obtained by a dry route, a wet route or by extrusion of a molten mass in the form of filaments (spun bonded sheet). The chemical textile material is generally synthetic. A sheet of continuous filaments is preferably employed, made of synthetic polymers such as polyamide or polyester, which exhibit good stability in the conditions of manufacture and use of the article.

Polyester-based filaments are advantageously employed. Polyethylene terephthalate by itself or in combination with polybutylene terephthalate may be employed as polyester, both polymers being spun together in the form of a twin component: bilaminar, side-to-side or coaxial, or spun separately out of the same die or out of different dies. The sheet filaments may be of any cross-section: flat, round or profiled. Filaments of round cross-section are preferably employed. The sheet is preferably consolidated by needling and advantageously by heat-bonding.

The characteristics of the sheet considered in isolation and in particular its tensile behaviour when cold are preferably already conforming or relatively close to the characteristics required in the case of the substrate within the scope of its use.

The weight of the nonwoven sheet can vary within wide limits, depending on the use. In general, it is between 20 and 500 g/m$^2$, preferably between 50 and 250 g/m$^2$, the invention being particularly advantageous in the case of the sheets with a weight of less than or equal to 150 g/m$^2$, which are the most likely to undergo distortions during the operations of manufacture of the article.

High-modulus threads denote threads which have a modulus of elasticity of more than 20 GPa and preferably more than 50 GPa (1 GPa$=10^9$ Pa); these values being measured at ambient temperature, but not being substantially modified when the threads are subjected to temperatures of the order of 200° C. and above. Threads based on the following materials may be mentioned as high-modulus threads: glass, aramids, aromatic polyamides, various high-tenacity polyesters, carbon, metal, and the like. Glass threads are preferably employed, these being widely available and relatively inexpensive. The high-modulus threads constitute a lengthwise reinforcement of the nonwoven sheet. They may be deposited onto one face or onto both faces or may be sandwiched in the nonwoven sheet. The reinforcing threads and nonwoven sheet may be combined by bonding with a suitable chemical binder, heat-bonding and/or needling, these means being expected to make it possible to obtain an excellent cohesion between the threads and the nonwoven sheet.

The quantity of reinforcing threads is a function of the characteristics of the sheet with which they are combined, in particular of its tensile behaviour when cold and at the temperatures reached during the process of manufacture of the article, and of the stresses withstood during this process. The minimum quantity is determined by the resistance required of the substrate (nonwoven sheet plus reinforcing threads) to the tensile stresses experienced at the high temperatures reached during the process of manufacture of the article. This quantity must be sufficient to prevent breaking of threads. It is such that when the reinforced sheet is subjected to the stress/lengthwise elongation test, breaking of the glass threads is recorded in the case of a stress of at least 80 and preferably of at least 100 daN per meter of width. The maximum quantity is determined as a function of the load/elongation curve of the nonwoven sheet when cold. It is determined so that the shape of the load/elongation curve of the reinforced sheet is as similar as possible to that of the unreinforced sheet. In particular, Young's modulus is not appreciably modified and the shape of the curve shows no major discontinuity when breaking of the reinforcing threads is recorded.

The quantity of reinforcing threads is expressed by means of the diameter (count) and density (spacing) parameters. These two parameters are optimized so as to have a substrate which behaves as homogeneously as possible. Since it is known that, in the case of a given type of sheet, the load/elongation curve depends essentially on its weight, in the preferred case of the use of glass threads and in the case of nonwoven sheets of continuous polyester filaments, whose weight is between 50 and 250 g/m$^2$ and depending on whether they are chemically bonded, heat-bonded and/or needled, use will advantageously be made of glass threads in which the diameter of the elementary fibres is between 5$\mu$ and 13$\mu$, whose count is between 2.8 and 272 tex and which are uniformly spaced at 2 mm to 30 mm. Use will preferably be made of glass threads whose count is between 22 and 68 tex, spaced at 10 to 30 mm; the counts shown above are those of the standard commercial threads.

In practice, in the case of the polyester sheets of the preferred weight of 50 to 250 g/m$^2$, and whatever the ultimate destination of the substrate (sealing, carpeting, floor tiles, etc.), the use of a few grams per m$^2$ of glass threads is sufficient; 2 to 3 g/m$^2$ of glass threads is sufficient in the case of sheets of 50 to 150 g/m$^2$ intended for the manufacture of sealing membranes; the run on a bitumen-treatment machine takes place without any problem in this case. In fact, the breaking load of the glass threads over 1 m of machine width can be calculated as follows. In the case of 2.244 g/m$^2$ of glass threads, that is to say 66 threads of 34 tex spaced at 15 mm, the breaking load per metre of width of glass thread sheet will be:

| 34 | × | 66 | × | 33.5 | = 75,174 g = | 75.174 kg |
|---|---|---|---|---|---|---|
| thread count in tex | | number of threads/m | | thread tenacity in g/tex | | that is, substantially 73.67 daN |

In the case of an assembly of threads onto a continuous filament polyester sheet of 110 g/m$^2$, followed by heat-bonding, breaking of the glass threads on a load/elongation curve of a test specimen 5 cm in width (3 threads considered) and 20 cm between tensometer jaws (according to AFNOR standard G07001) is recorded at 18 daN, which corresponds to $18 \times 20 = 360$ daN per 1 m width. This considerable apparent increase in the initial breaking load of the glass threads is explained by the excellent threads/nonwoven cohesion as a result of the many regions of adhesive bonding of the threads in the textile structure by means of the molten binding fibres and giving rise to a perfectly homogeneous breaking behaviour of the whole.

As will be seen in greater detail in the examples, inspection of the load/cold elongation curve of the said nonwoven sheet reinforced with glass threads in a metered quantity shows:

a Young's modulus when cold which is identical in the lengthwise direction when compared with the same nonwoven, unreinforced sheet, at approximately half-load, breakage of the glass threads without resulting in an excessively great break in the curve.

On the other hand, inspection of the load/elongation at 180° C. curve shows a marked improvement in the Young's modulus when heated. This modulus is multiplied by at least 2 and preferably by 2.5 to 3.

According to the these tests, it can be clearly seen that the stabilization can be perfect during a bitumen-treatment operation, the machine tensile forces not exceeding 100 daN/m of width and that, on the other hand, the dimensional stability of the product in the conditions of use will be markedly improved, this being due to the reduction in the memory effect. These results are obtained with very little glass and for a minimum cost of the order of 0.08 FF/m$^2$. This material cost should be compared with a cost of approximately 0.80 FF/m$^2$. in the case of a glass voile of 50 g/m$^2$, frequently employed in coverings with a twin reinforcement of polyester and glass voile or else with the production of a $1 \times 1 \times 34$ tex nonwoven-glass grid composite (1 thread/cm as warp and weft), a structure considered to be the minimum from a practical standpoint, and the cost of which, in all cases, is more than 1 FF/m$^2$.

The present application also relates to a process for the manufacture of the above substrate, characterized in that, during the manufacture of a nonwoven sheet of chemical textile material or after its manufacture, reinforcing threads are introduced by a suitable means and are arranged continuously parallel to each other at a predetermined distance against a least one of the faces of the nonwoven sheet or between two layers and that the bonding between the said threads and the said sheet is produced.

To produce the sheet by the melt route, the polymer is extruded and the sheet is manufactured preferably by employing the means described in the Applicant Company's French Patent 1,582,147 and 2,299,438. The placing of the reinforcing threads can be done continuously or noncontinuously. In both cases, the threads are fed from beams or reels arranged in the vicinity of the sheet and distributed so that they unwind parallel to each other at a uniform predetermined spacing in the lengthwise direction. The placing of the reinforcing threads is preferably carried out continuously with the manufacture of the sheet, immediately after the latter or during the latter, during the coating.

Bonding of the threads to the sheet is carried out either by application of a chemical binder or preferably by needling and/or heat-bonding.

In the case of chemical bonding it is possible to employ either threads coated with a chemical adhesive or, in the case of chemically bonded sheets, to introduce the threads into the sheet when the latter is being chemically bonded.

In the case of heat-bonding, it is possible to employ either threads coated with a hot-melt adhesive product or wrapped with a hot-melt adhesive thread or, in the case of heat-bonded sheets, to introduce the threads into the sheet during its manufacture and to bond the sheet and threads while the sheet is being heat-bonded. The first solution: hot-melt adhesive threads, is, for example, employed in the case of heat-bonding, without prior needling and threads applied at the surface.

In the case of needling, special needles are preferably employed, the reinforcing threads being embedded in the surface or in the bulk of the entangled textile filaments. For example, in the case of needling and assembly of the threads on one face, use is made of special needles with a round cross-section with two opposite ridges provided with barbs positioned oriented in the lengthwise direction, so as not to touch the reinforcing threads: such as the Pinch Blades type Fosters Needles.

In the case of the introduction of reinforcing threads in a laying, stage according to a travelling process, it is desirable to incorporate the threads between two laying devices. In this case it will be possible to employ standard needles (for example: Singer 40 RB needles) to produce first cohesion by needling the sheet. In fact, it is found that, using this process, the reinforcing threads can be made to cohere to the whole more easily, while withstanding an agressiveness of the needles, bearing in mind the protection by the sheet filaments situated on both sides of these threads. This needling will be advantageously followed by an in-line heat-bonding. During these successive operations, good care will have been taken to apply a sufficient tension to the assembly of chemical filament sheet and reinforcing threads, so that the latter are perfectly stretched throughout the consolidation stages in order to obtain a maximum modulus of elasticity in the lengthwise direction of the reinforced sheet constituting the substrate for an article according to the invention.

To produce the sheet by a dry route, the processes employed are those normally used in this technique. The incorporation of the reinforcing threads, their bonding to the sheet and the optional consolidation of the latter are carried out in the same way as in the case of the sheets obtained by a melt route.

To produce the sheet by a wet route, the processes employed are those normally used in this technique. The combination of the reinforceing threads takes place after the manufacture of the sheet and their bonding to the latter is performed by chemical or thermal adhesive bonding to the said sheet or between two lighter sheets.

The substrate based on a nonwoven sheet for flat articles, according to the invention, offers many advantages in all the cases of use: sealing membrane reinforcement, primary or secondary substrate for tuft carpeting, reinforcement for floor covering tiles, and the like.

1—From a general standpoint elimination of distortions of the sheet under mechanical stresses at elevated temperature during the treatments included in the process of manufacture of the article;

elimination of the inverse distortions on aging in the article when laid, remedying the previous distortions;

material saving and low cost of manufacture.

2—In the case of a sealing membrane, in comparison with the use of two reinforcements: glass voile and nonwoven, which are impregnated simultaneously and bonded together during the impregnation:

substantial saving in the raw materials;

elimination of a double reinforcement storage by the manufacturer of bitumen-treated coverings;

ease of impregnation, giving the possibility of a substantial increase in the rates of covering production;

elimination of problems of appearance of the covering due to the use of 2 reinforcements of very different modulus: folds, cracks, corrugations, and the like;

much more satisfactory mechanical breaking behaviour: better continuity of the load/elongation curve of the covering, resulting in a better fatigue resistance (fissuring);

greater flexibility of the covering, making coverings easier to lay in cold weather.

3—In the case of a sealing membrane, when compared with the nonwoven-glass grid composites or with nonwoven-glass voile composites (combined before impregnation):

easier limitation of the total quantity of glass per $m^2$;

saving in raw materials;

easy impregnation;

more homogeneous mechanical breaking behaviour because of a limitation in the quantity of glass;

greater flexibility of the covering;

elimination of the risks of change in appearance and/or in the dimensional aspect which are due to the different physical behaviour of the two sheets during the impregnation and the subsequent use.

However, the invention will be understood better with the aid of the examples and figures below, which are given by way of illustration, no limitation being implied.

FIG. 1A shows the comparison of load/cold elongation diagrams of a nonwoven sheet without reinforcing thread and of a substrate: nonwoven sheet plus reinforcing threads combined, according to the invention, in the lengthwise direction.

FIG. 1B shows the comparison of load/cold elongation diagrams of a nonwoven sheet without reinforcing thread and of a substrate: nonwoven sheet plus reinforcing threads combined, according to the invention, in the transverse direction.

FIG. 2A shows the comparison of load/elongation diagrams of the same sheets as in FIG. 1A, at a temperature of 180° C. in the lengthwise direction.

FIG. 2B shows the comparison of load/elongation diagrams of the same sheets as in FIG. 1B, at a temperature of 180° C. in the lengthwise direction.

Figure 3:
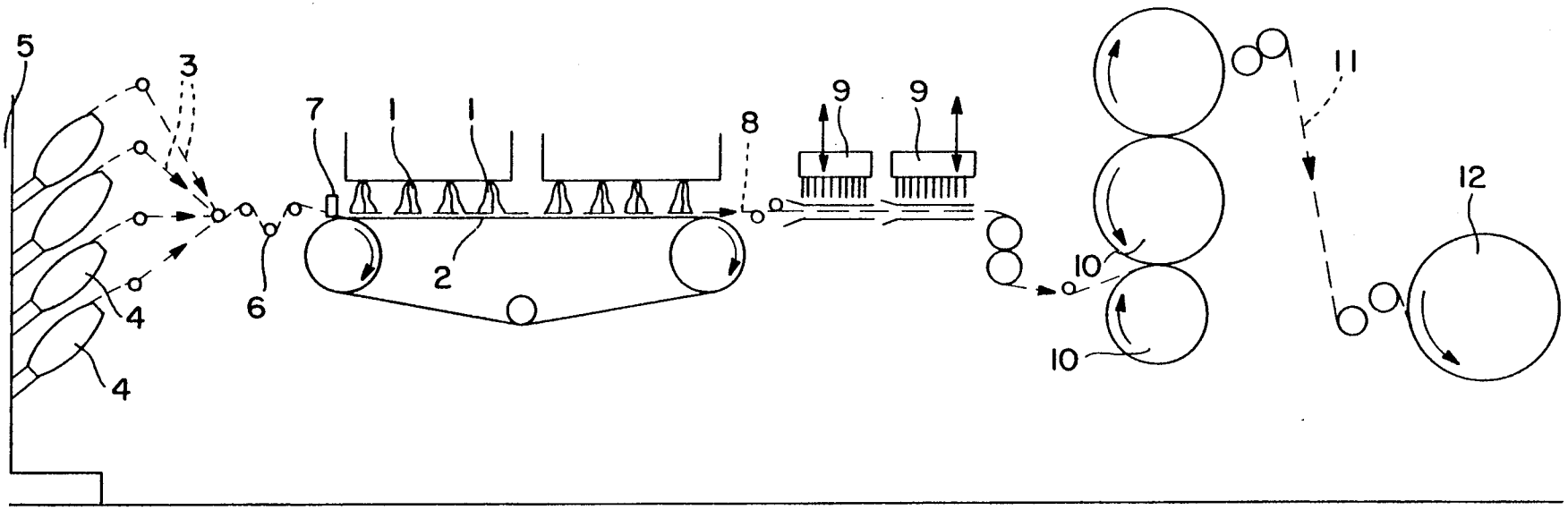
FIG. 3 shows diagrammatically a first embodiment of the process according to the invention.

According to the process shown diagrammatically in FIG. 3, the substrate is produced in a single stage, the reinforcing threads being combined with and bonded to the nonwoven sheet in the course of the latter's manufacture. The sheet is manufactured by a melt route, according to the process described in French Patent 1,582,147, by extrusion of a molten polymer in the form of filaments 1, pneumatic drawing of these filaments and deposition on a receiving apron 2 with the use of a coating device of the travelling type, not shown, such as described in French Patent 2,299,438. The reinforcing threads 3 are combined with the sheet being formed, as soon as it enters the receiving apron. They are fed from reels 4, mounted on a feed creel 5, pass over a tensioning bar system 6, and then each through a guiding eyelet 7. The eyelets 7, aligned and judiciously spaced, at the entry of the receiving apron 2, are intended to ensure the guidance of the threads 3 parallel to each other and with the desired spacing on the receiving apron 2. The nonwoven sheet 8 is therefore formed on the receiving apron 2, with the reinforcing threads 3 being integrated onto its lower face. On leaving the receiving apron 2, the sheet and the reinforcing threads pass continuously through the needler 9, where they are subjected to a needling operation ensuring a part of the sheet/reinforcing thread bonding. The bonding is completed by heat-bonding on passing through the calender 10. The substrate 11 according to the invention which is thus produced is wound onto a receiving means 12.

Figure 4:
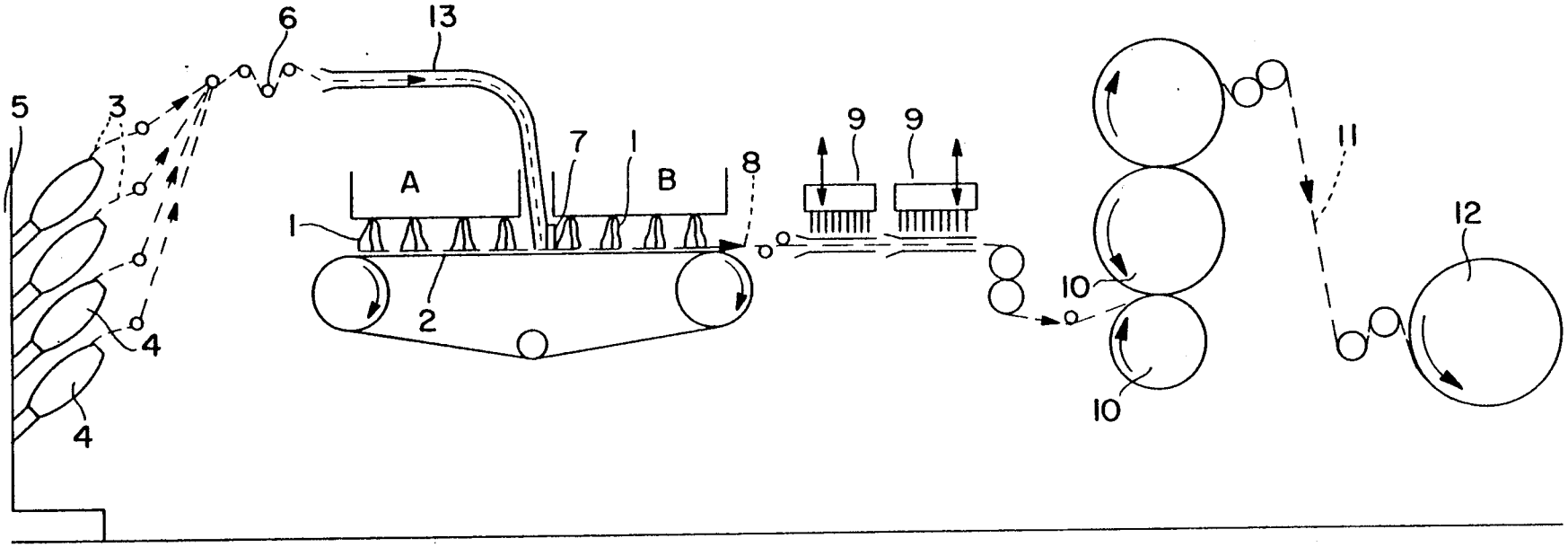
FIG. 4 shows diagrammatically a second embodiment of the process according to the invention.

The process shown diagrammatically in FIG. 4 is similar to that shown diagrammatically in FIG. 3, and differs from it only in the feed of the reinforcing threads 3 onto the receiving apron 2. Here, the threads are arranged between two layers of the sheet and are fed onto the receiving apron between two laying devices situated at A and B respectively by means of individual guiding tubes 13. As in FIG. 3, an eyelet 7 is arranged at the exit of each tube 13, the set of eyelets being responsible for the parallel positioning of the threads with the desired spacing.

EXAMPLE 1

A nonwoven filament sheet of 100 g/m$^2$ 2 m in width is produced from extruded polyethylene terephthalate and polybutylene terephthalate threads, in a proportion of 87%/13% respectively, filaments of 7 dtex count.

A Silionne type EC 9 34 T 6 Z 28 glass thread (fibre diameter 9 microns, 34 tex, type 6 sizing, Z 28 t/m twist) from the VETROTEX company is incorporated continuously every 1.5 cm in this sheet at the time of the coating, using the means shown diagrammatically in FIG. 4.

These threads have a tensile strength of 33.5 g/tex and an elongation at break of approximately 5.5%. They are fed from 2.7 kg reels mounted on a creel such as shown in FIG. 4.

The polyester sheet + glass threads composite is needled with Singer 40 RB needles (40 gauge, Regular barbs), 50 perforations/cm$^2$, 12 mm penetration.

On leaving the needler, the sheet is calendered at 235° C. under a pressure force of 25 daN/cm on a calender fitted with rolls with nonstick coating. Conditions: calender speed 13 m/min, S pass, total time of contact between the sheet and the two rolls: 15 seconds, followed by a pass over cooling rolls and winding.

A reinforced sheet weighing 107 g/m$^2$ is thus obtained. The mechanical strength characteristics of this reinforcement, compared with those of a reinforcement without glass threads are shown in Tables 1 and 2, which follow. Table 1 relates to the characteristics measured cold (20° C.), Table 2 the characteristics measured at 180° C. The characteristics are measured on a test specimen 5 cm in width (3 threads considered) and 20 cm in length; cold according to NF standard G 07001 and hot according to the same dimensional criteria and pulling speed, but the pulling system and the test specimen fixed in the jaws are in a heat chamber controlled at a temperature of 180° C. The load/elongation curves are reproduced in FIGS. 1 (cold) and 2 (at 180° C.), L: lengthwise direction, T: transverse direction, $C_1$: with threads, $C_2$: without threads.

With reference to Table 1 and to FIG. 1, it can be seen that the load and the elongation at break of this lengthwise reinforcement are changed very little when glass is added. It can also be seen that the lengthwise elongations under 3 daN and 5 daN remain unchanged and that the elongation under 10 daN is itself also practically unchanged. This reflects the absence of change in Young's modulus. The breaking of the glass threads at 18 daN is well localized in the lengthwise breakage, and this constitutes a major increase in the breaking load, since, taken out of the sheet, the three threads considered together have a theoretical breaking load of 3.35 daN. This breakage does not result in a perturbation in respect of the nonwoven, whose breakage curve continues without appreciable modification.

With reference to Table 2 and FIG. 2, the tensometer curve at 180° C. shows a major increase in the modulus at the origin of the reinforced sheet. The elongations under 3 daN, 5 daN and even 10 daN are markedly reduced. Since it is known that the stresses to which the substrate (the reinforcement) is subjected during the bitumen treatment are at most from 80 to 100 daN per linear meter that is to say 4 daN to 5 daN per 5 cm width, this results in a very small distortion of the substrate during bitumen treatment (or other hot treatment according to its final destination) and hence in an improved dimensional stability both during the bitumen treatment or other heat treatment and subsequently, once the substrate is in place. The breakage of the glass threads is recorded at 5 daN, a value which is sufficiently high to conclude therefrom that the reinforced sheet will withstand the stresses undergone during the bitumen treatment (or other heat treatment) without the risk of breakage of the glass threads, The reinforcement was also tested with heating and under tension in the bitumen.

Figure 5:
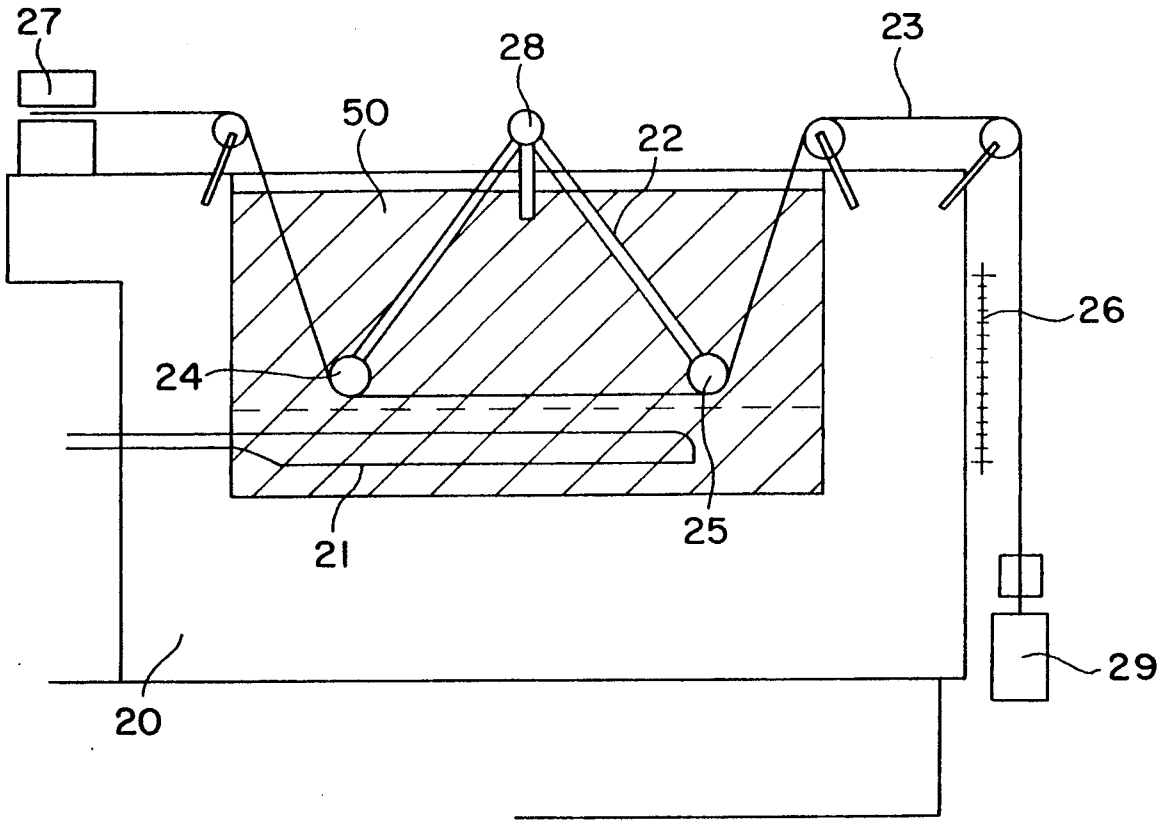
FIG. 5 shows diagrammatically an apparatus for measuring the characteristics of a sealing membrane produced using the support according to the invention.

The bitumen test is performed with the aid of the apparatus shown in FIG. 5. The latter consists chiefly of a trough 20 intended to receive the bitumen 50, equipped with means of heating and controlling the temperature 21, a removable basket 22 of calibrated dimensions, intended for introducing and maintaining the test specimen 23 in the trough, various guides or return pulleys 24–25 to define the travel of the test specimen and a reading scale calibrated in millimetres 26.

The bitumen employed is an impregnating bitumen of the Shell company (ref. 100–130 PX), penetration 100/130 (penetration in 1/10th of mm at 25° C., measured according to NF standard T 66004).

The 10×120 cm test specimens are cut out in the lengthwise direction of the sheet. Three test specimens taken from the width are employed, one in the middle and one at each edge, 10 cm from the selvedge.

The test takes place according to the following method:

The apparatus heating is switched on temperature 185° C., and the temperature is allowed to stabilize.

A clip is attached at each end of the test specimen 23, one of these 27 constituting a stationary point.

The test specimen is introduced into the hot bitumen with the aid of the basket 22 which then rests on the bottom. The basket is immobilized with a bar clip 28, the bitumen level and the dimensions of the basket being determined so as to have a length of 500 mm immersed in the bitumen.

The load 29 is fixed, that is to say 4 daN and then 7 daN for a sheet of 107 g/m$^2$.

After a waiting period of 30 s, the elongation is determined with the aid of the millimeter scale.

The elongation is expressed as a percentage of the immersed length

After the load and the basket have been withdrawn, the test specimen is withdrawn and is drained with the aid of a suitable device.

The test specimen is suspended vertically and, after complete cooling, the shrinkage in width is measured and is expressed as a percentage of the width.

The values are recorded in Table 3 below.

Another test, more accurate, is carried out in a heat chamber at 200° C., on test specimens 20 cm in width and 30 cm in length (length of the test specimen taken in the lengthwise direction of the sheet) between clips. The test specimen is suspended, using the upper clip, in the heat chamber at 200° C. with a load of 8 daN hooked to the lower clip. The change in the dimension of the test specimen is measured after cooling to ambient temperature, in the lengthwise direction and the transverse direction and these changes are expressed in %.

The values are recorded in Table 4 below.

In these two tests, a very markedly improved behaviour is found in the distortion on heating and under tension of the reinforced nonwoven when compared with the unreinforced nonwoven (see the various degrees of distortion in Tables 3 and 4).

The substrate based on a nonwoven can be used as a sealing membrane reinforcement.

Figure 6:
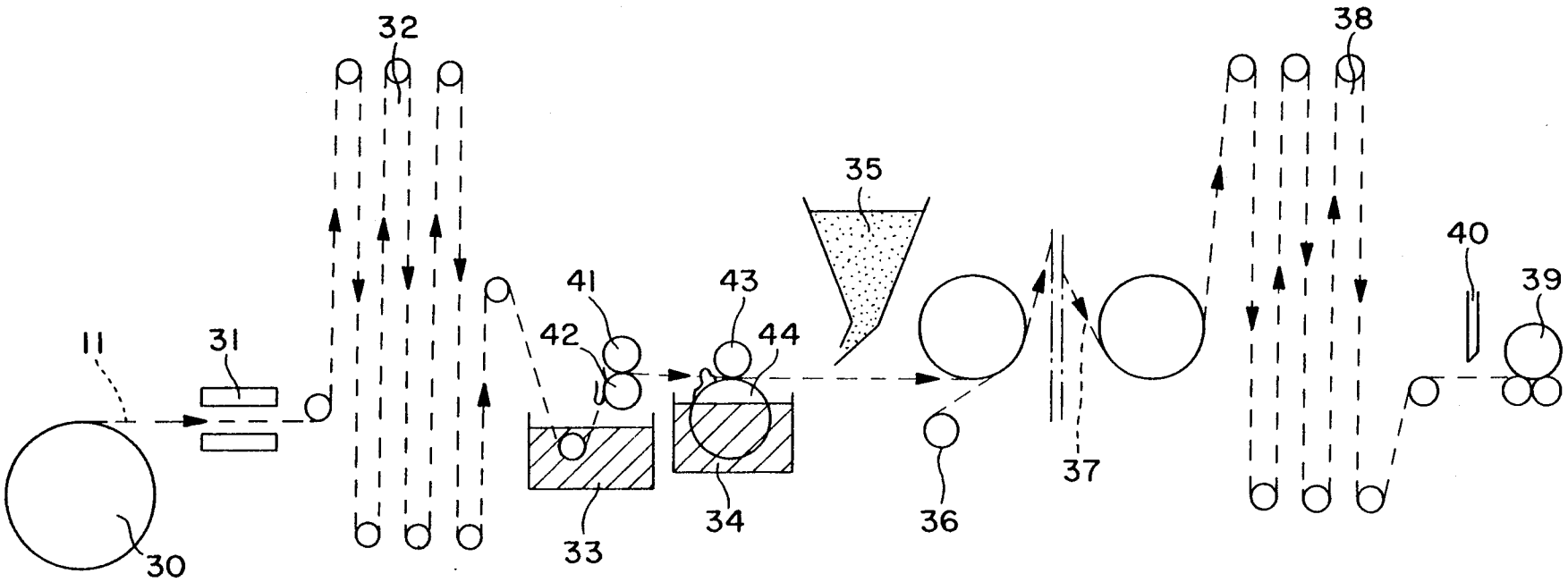
FIG. 6 illustrates diagrammatically a process for the manufacture of a sealing membrane using the substrate according to the invention.

The bitumen treatment of the reinforcement is carried out by the manufacturer of the bitumen-treated covering by means of the plant shown diagrammatically in FIG. 6. The reinforcement 11 is unwound from a feed roll 30, and then passes through an assembly station 31 and into a storage cell 32. The assembly station enables the beginning of a new roll to be attached to the end of the reinforcement length being treated and the storage cell makes it possible to absorb the discontinuities in the feed. The reinforcement then passes through a first bitumen treatment station 33, a second bitumen treatment station 34, a slate treatment station 35, a plastic film application station 36, a cooling zone 37, a second storage cell 38, and is received on a receiving device 39 fitted with a means 40 for cutting the reinforcement when the winding at the receiving end has reached the desired size.

The bitumen treatment is performed in two stages:

a first full bath impregnation stage at 180° C. (station 33) followed by draining between metal rolls 41–42 with an oxidized bitumen of 100/40 type, penetration 40/10ths of mm (according to NF standard T 66.004), ball-and-ring softening point 100° C. (according to NF standard T 66.008).

a second, so-called surface treatment stage (station 34) by coating both faces with an elastomeric bitumen of SBS (styrene-butadiene-styrene) type at 175° C., followed by a size calibration between rolls 43–44 with a preset gap depending on the desired thickness of the covering, deposition of slate flakes onto 1 face and of a polypropylene film onto the other face and cooling on drums in the zone 37.

This same unreinforced reinforcement of 107 g/m$^2$. could not have been subjected to the bitumen treatment without a very large distortion in the machine in the lengthwise and transverse direction with an extremely corrugated appearance rendering the covering completely unusable.

In the present case the behaviour during the bitumen treatment is excellent and the covering is perfectly flat in appearance. The subsequent behaviour of the covering in the dimensional stability test at 80° C., recommended by the UEATC (Union Européenne pour l'Agrément Technique dans la Construction) is in accordance with the dimensional variation requirements, that is to say variations of less than 0.5% in both directions.

The invention is obviously not limited to the example described, but includes all the embodiments entering within the scope of the general definition.

TABLE 1

| | Test with glass thread | Control without glass thread |
|---|---|---|
| Mass per unit area (g/m$^2$) | 107 | 106 |
| Breaking load LD* (daN) | 32.0 | 30.6 |
| Breaking load TD* (daN) | 31.2 | 27.7 |
| Isotropy: LD/TD | 1.02 | 1.1 |
| Elongation LD (%) | 23.3 | 26.4 |
| Elongation TD (%) | 24.4 | 24.0 |
| Elongation/3 daN-LD (%) | 0.3 | 0.3 |
| Elongation/5 daN-LD (%) | 0.5 | 0.5 |
| Elongation/10 daN-LD (%) | 1.1 | 1.2 |
| Elongation/3 daN-TD (%) | 0.3 | 0.3 |
| Elongation/5 daN-TD (%) | 0.5 | 0.6 |
| Elongation/10 daN-TD (%) | 1.2 | 1.4 |
| Breaking energy-LD-(J) | 11.2 | 12.0 |
| Breaking energy-TD-(J) | 11.2 | 10.0 |
| Glass threads breaking load (daN) | 18.0 | — |
| Glass threads elongation at break (%) | 2.2 | — |

*LD = lengthwise direction
TD = transverse direction

TABLE 2

| | Test with glass thread | Control without glass thread |
|---|---|---|
| Mass per unit area (g/m$^2$) | 107 | 106 |
| Breaking load (daN)-LD | 21.0 | 16.7 |
| Breaking load (daN)-TD | 16.7 | 19.6 |
| Isotropy: LD/TD | 1.25 | 0.85 |
| Elongation (%)-LD | 27.0 | 23.6 |
| Elongation (%)-TD | 21.3 | 23.3 |
| Elongation/3 daN (%)-LD | 0.9 | 2.1 |
| Elongation/5 daN (%)-LD | 1.9 | 3.9 |
| Elongation/10 daN (%)-LD | 6.4 | 9.6 |
| Elongation/3 daN (%)-TD | 1.6 | 1.6 |
| Elongation/5 daN (%)-TD | 3.3 | 3.3 |
| Elongation/10 daN (%)-TD | 8.9 | 8.9 |
| Breaking energy (J)-LD | 6.3 | 4.7 |
| Breaking energy (J)-TD | 4.3 | 5.5 |
| Glass threads breaking load (daN) | 5.2 | — |
| Glass threads elongation at break (%) | 2.0 | — |

TABLE 3

| | Test with glass thread | Control without glass thread |
|---|---|---|
| Mass per unit area (g/m²) | 107 | 106 |
| Reinforcement thickness (mm) | 0.45 | 0.48 |
| Bitumen test with 4 daN load | | |
| elongation LD (%) | 0.7 | 1.9 |
| shrinkage TD (%) | 0 | 0.5 |
| Bitumen test with 7 daN load | | |
| elongation LD (%) | 1.3 | 3.7 |
| shrinkage TD (%) | 0 | 1 |

Test specimen width: 10 cm

TABLE 4

| | Test with glass thread | Control without glass thread |
|---|---|---|
| Mass per unit area (g/m²) | 107 | 106 |
| Reinforcement thickness (mm) | 0.45 | 0.48 |
| Heat shrinkage 200° C.-10'-LD (%) | 0.7 | 0.9 |
| Heat shrinkage 200° C.-10'-TD (%) | 0.1 | 0.1 |
| Creep (200° C.-15') under 8 daN: | | |
| elongation LD (%) | 0.4 | 2.4 |
| shrinkage TD (%) | 0.5 | 1.7 |

Test specimen width: 20 cm
LD = lengthwise direction
TD = transverse direction

We claim:

1. A substrate based on a nonwoven sheet for a flat article, with good dimensional stability in all the conditions of production, subsequent treatments and use, comprising a nonwoven sheet of synthetic textile material in the form of fibres or of continuous filaments, said sheet having a weight of between 20 and 500 g/m² and, bonded thereto, high modulus reinforcing threads exhibiting a Young's modulus of more than 20 GPa arranged parallel to each other in the lengthwise direction of the nonwoven sheet, the quantity of reinforcing threads being such that, when the substrate is subjected to tensile forces in the lengthwise direction at 180° C., the breaking stress of the reinforcing threads is at least 80 daN per meter of width, and the Young's Modulus of the substrate at ambient temperature is not appreciably modified relative to the same modulus, measured in the same conditions, of the nonwoven base sheet without reinforcing threads.

2. Substrate according to claim 1, characterized in that it has a Young's modulus at 180° C. which is at least equal to twice the same modulus, measured in the same conditions, of the nonwoven base sheet without reinforcing threads.

3. Substrate according to claim 2, characterized in that it has a Young's modulus at 180° C. of between 2.5 and 3 times the same modulus, measured in the same conditions, of the nonwoven base sheet without reinforcing threads.

4. A substrate according to claim 1 wherein the nonwoven sheet is a sheet obtained by extruding molten synthetic textile material in the form of continuous filaments to form a spun-bonded sheet, and having a weight of between 20 and 250 g/m².

5. A substrate in claim 1, according to which the nonwoven sheet is a sheet of polyester-based continuous filaments, obtained by extruding molten synthetic textile material in the form of filaments to form spun-bonded sheet, and having a weight of between 50 to 250 g/m², wherein the reinforcing threads are glass threads with a count of between 2.8 and 272 tex and uniformly spaced at 2 to 30 mm.

6. Substrate according to claim 5, characterized in that the glass threads have a count of between 22 and 68 tex and are spaced at 10 to 30 nm.

7. Substrate according to claim 1, characterized in that the bonding of the reinforcing threads to the sheet is performed by chemical bonding.

8. Substrate according to claim 1, characterized in that the reinforcing threads are bonded to the sheet by heat-bonding, needling, or by heat-bonding and needling.

9. A bitumen-threaded sealing membrane reinforced with the substrate of claim 1.

10. A tuft carpeting comprising the substrate of claim 1 as a primary or secondary substrate.

11. A floor-covering tiling further comprising the substrate of claim 1 as a reinforcement.

12. The substrate according to claim 1 further comprising a coating.

13. The substrate according to claim 1 further comprising a flock on one surface thereof.

14. The substrate according to claim 1 wherein the reinforcing threads have a Young's modulus of more than 50 GPa.

15. The substrate of claim 14 wherein the breaking of the reinforcing threads takes place under a stress of at least 100 daN per meter of width.

16. The substrate according to claim 1, wherein the nonwoven sheet has a weight between 50 and 150 g/m² comprising polyester-based filaments and wherein the reinforcing threads are glass threads and are present in amount of 2 to 3 g/m².

* * * * *